United States Patent [19]

Buck

[11] Patent Number: 4,824,342

[45] Date of Patent: Apr. 25, 1989

[54] CHEMICAL INJECTOR SYSTEM FOR PISTON PUMPS

[75] Inventor: Michael D. Buck, Minneapolis, Minn.

[73] Assignee: Hypro Corp., St. Paul, Minn.

[21] Appl. No.: 156,325

[22] Filed: Feb. 16, 1988

[51] Int. Cl.[4] ..... F04B 21/02

[52] U.S. Cl. ..... 417/503; 417/539

[58] Field of Search ..... 417/507, 568, 539

[56] References Cited

U.S. PATENT DOCUMENTS

| | | | |
|---|---|---|---|
| 2,266,125 | 12/1941 | Malsbary | 417/503 |
| 3,597,125 | 8/1971 | Sadler | 417/503 |
| 3,849,032 | 11/1974 | Mulvey | 417/503 |
| 4,087,213 | 5/1978 | Hadama | 417/568 |
| 4,147,478 | 3/1979 | Vork | 417/503 |

FOREIGN PATENT DOCUMENTS

| | | | |
|---|---|---|---|
| 2613702 | 10/1977 | Fed. Rep. of Germany | 417/503 |

*Primary Examiner*—William L. Freeh

*Attorney, Agent, or Firm*—Orrin M. Haugen; Thomas J. Nikolai; Frederick W. Niebuhr

[57] ABSTRACT

An injector device for a plunger-type pump of the type having one or more cylinders, an intake valve for each cylinder operatively disposed between the pump's low pressure inlet port and each of its cylinders and outlet valve(s) for each cylinder operatively disposed between the cylinders and the pump's high pressure outlet port, where the intake and outlet valves are held in place by removable threaded plugs which afford access to the valves so that they can be repaired or replaced. The injector device comprises a threaded plug member adapted to replace one of the removable plugs used to hold an intake valve in place, but also includes a longitudinal bore in which is mounted a one-way check valve. The inlet side of the check valve is adapted to be coupled to a chemical supply tank. Also, a restrictor is placed between the particular intake valve held in place by the injector plug and the pump's inlet port. During a suction stroke of that one plunger, both a first fluid and the chemical from the supply tank are drawn into the one cylinder. Here, the two fluids mix before being ejected through the pump's high pressure outlet during the pressure stroke of the particular plunger with which the injector is associated.

5 Claims, 2 Drawing Sheets

CHEMICAL INJECTOR SYSTEM FOR PISTON PUMPS

BACKGROUND OF THE INVENTION

I. Field of the Invention

This invention relates generally to high pressure industrial pumps, and more particularly to an improved means for introducing one or more chemicals in metered amounts into the fluid stream being delivered through the pump's high pressure outlet port.

II. Discussion of the Prior Art

In certain system applications, it is desired that a first fluid, e.g., water, be delivered at a high pressure and that a chemical, e.g., liquid soap, be mixed with the high pressure fluid stream. Such an arrangement is commonly used in high pressure washing equipment. For example, in automatic car wash systems, it is desirable to deliver a soap solution from a dispensing nozzle at a pressure in the range of from 800 to 1,000 psi. In prior art arrangements, a venturi-type injector is commonly used to draw liquid soap concentrate from a supply tank and to mix it with the water stream as it passes through the throat of the venturi. For a venturi injector to work, however, it is requirement that there be a significant pressure drop across it to create the necessary vacuum for drawing the soap concentrate from its supply tank. This, of course, detracts from the pressure available to dislodge the dirt and grime from the object being washed.

In still another prior art arrangement, the chemical source is placed at a higher elevation than the pressure pump and a needle valve in a supply line is used to control the flow of soap concentrate into the wash stream at the inlet of the pump.

It was also known prior to my invention that the suction stroke of a positive displacement pump can be used to create the requisite negative pressure for drawing the soap concentrate into the cylinder, again through a needle valve assembly used in place of the usual inlet poppet valve which opens on the suction stroke but closes on the pressure stroke. Such a needle valve assembly is relatively costly and may be easily damaged by improper or frequent opening and closing thereof.

SUMMARY OF THE INVENTION

The present invention is deemed to be an improvement over the above-described prior art arrangements, especially the latter arrangement wherein the needle valve is used in place of the pump's inlet valve. In multicylinder pumps, a series of threaded plugs are used to provide access to the pump's inlet poppet valves so that they can be readily removed and replaced when worn. These plugs also serve to positively hold the inlet poppet valves in position in the cylinder head so the valve cannot move. In accordance with the present invention, a restriction orifice in the form of a washer having a center aperture of a predetermined size is placed in the base of one of the bores designed to receive the inlet poppet valves and an inlet poppet valve is then placed on top of the washer. This assembly is held in position by a threaded plug which differs from the others in that it has a longitudinal bore with a check valve positioned in that longitudinal bore. The check valve is configured to permit the chemical soap concentrate to be drawn through the longitudinal bore during the suction stroke of the cylinder in which the injector assembly is associated. During that cylinder's pressure stroke, the check valve closes, precluding the chemical/water mixture from being forced back into the line leading to the chemical supply tank. The restrictor washer functions to determine the water/chemical ratio drawn into the cylinder during the pump's suction stroke.

The injector assembly of the present invention thus performs two functions. It first serves to hold the pump's conventional intake valve in position in the cylinder head and, secondly, provides a way of introducing the chemical concentrate into the fluid stream. It does not require an expensive and easily damaged needle valve and, further, it does not introduce a pressure drop as does the prior art venturi-type injector.

DESCRIPTION OF THE DRAWINGS

The foregoing features and advantages of the invention will become apparent to those skilled in the art from the following detailed description of a preferred embodiment of the invention, especially when considered in conjunction with the accompanying drawings in which like numerals in the several views refer to corresponding parts.

DESCRIPTION OF THE PREFERRED EMBODIMENT

Figure 1:
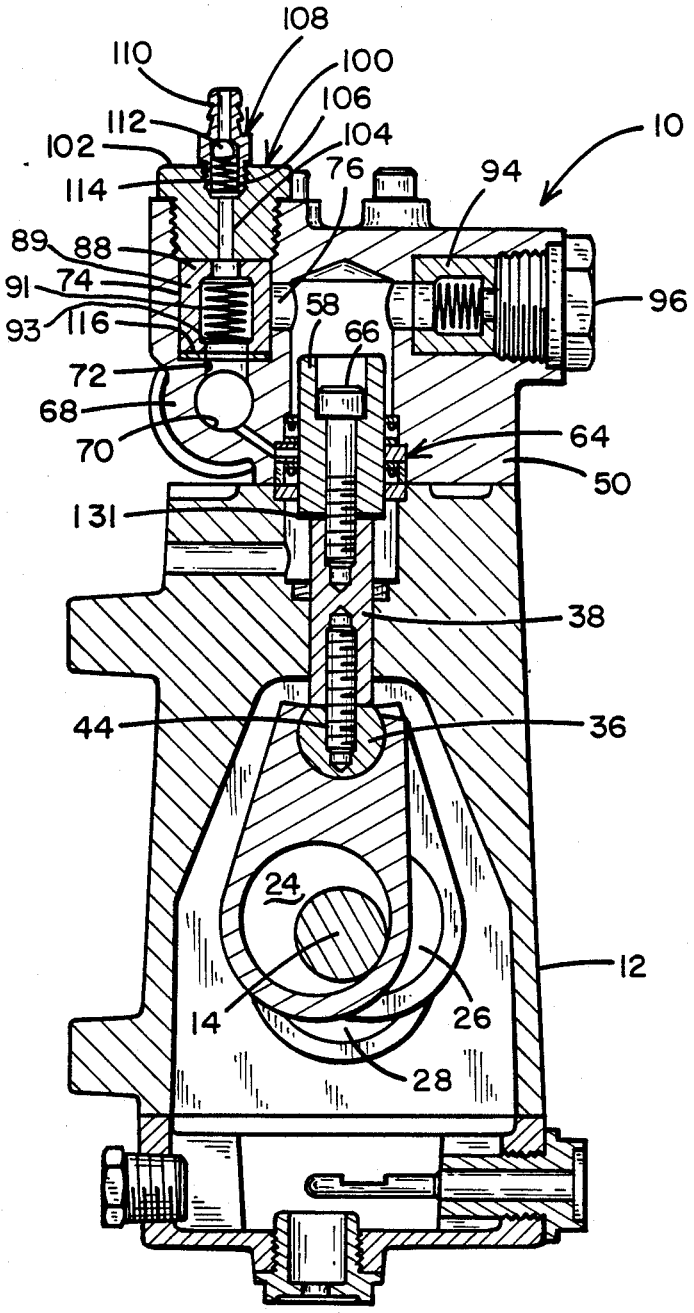
FIG. 1 is a side sectional view of a multicylinder positive displacement pump incorporating the injector of the present invention.

Referring to Figures and 2, there is indicated generally by numeral 10 a multicylinder, positive-displacement plunger pump. The pump comprises a crank case 12 containing a crank shaft 14 which is journaled for rotation by needle bearings 16 and 18 contained in bearing retainers 20 and 22, respectively. Formed on the crankshaft 14 are a plurality of eccentric lobes 24, 26 and 28 which, in a three-cylinder pump, are disposed at angles of 120° relative to one another. Surrounding each of the eccentric lobes 24, 26 and 28 are connecting rods 30, 32 and 34.

Floating wrist pins of the type described in U.S. Pat. No. 4,381,179 to Pareja are identified by numeral 36 are used to join the connecting rods to plunger shafts 38, 40 and 42 by a threaded connector 44. The plunger shafts pass through a bore in the pump's block and low pressure cup seals, as at 46, provide a seal against the reciprocating shaft to prevent any fluid which is being pumped from entering the crank case and contaminating the oil contained in the crank case for lubricating the crank shaft bearings and the floating wrist pins.

Figure 2:
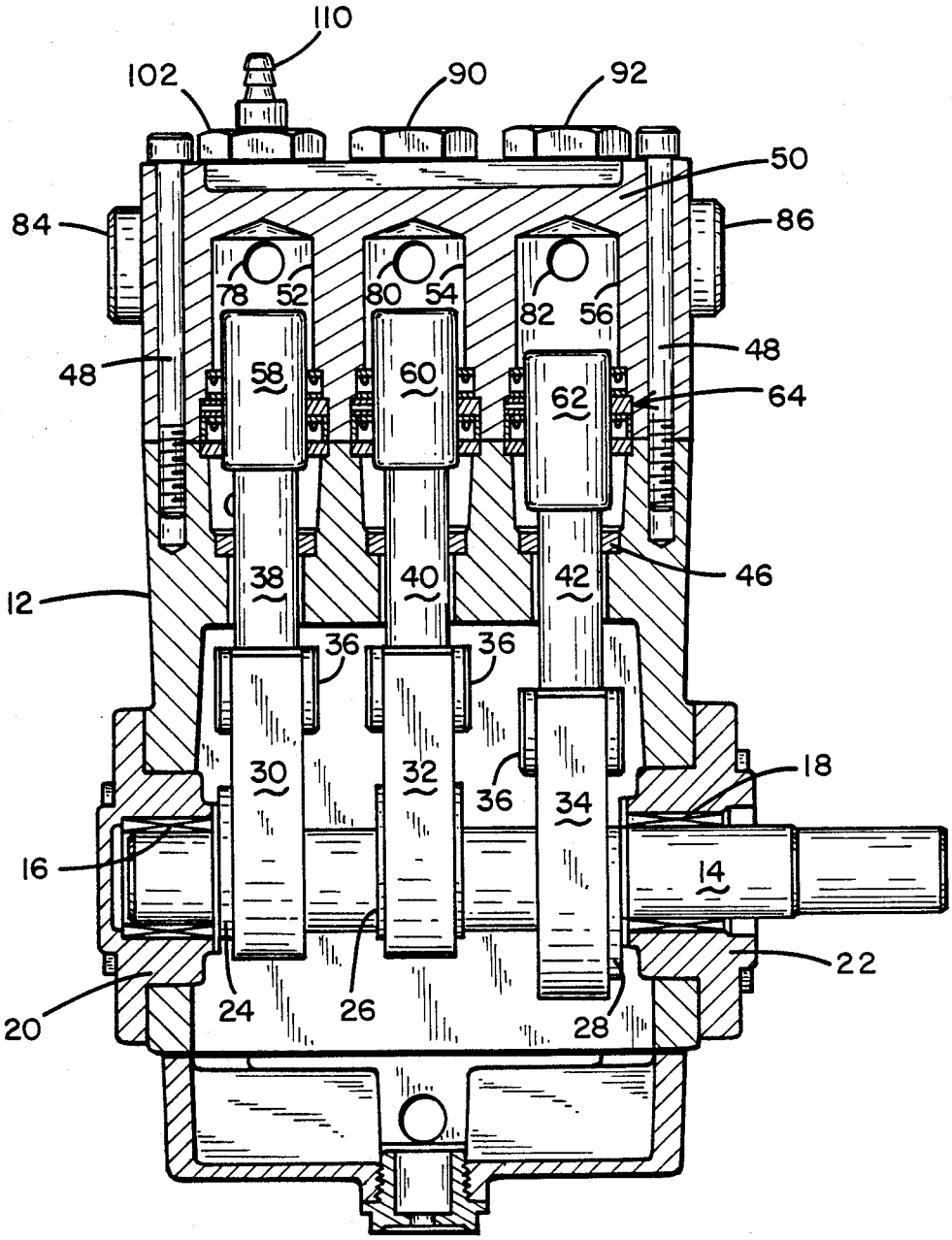
FIG. 2 is a front cross-sectional view of the pump of FIG. 1.

Attached by bolts 48 to the pump's block is a cylinder head casting 50. As can best be seen in FIG. 2, cylinder head 50 includes a plurality of cylinder bores 52, 54 and 56 in which plunger members 58, 60 and 62 reciprocally move as the crank shaft 14 is driven. High pressure seal assemblies, as at 64, surround the plungers to preclude leakage of the liquid being pumped along the peripheral surface of the plungers. Details of construction of the seal assemblies 64 is described in Pareja U.S. Pat. No. 4,381,179, assigned to the assignee of the present invention. As can be seen in FIG. 1, the plungers 58, 60 and 62 are connected to the plunger shafts 38, 40 and 42 by means of bolts as at 66.

The cylinder head 50 includes an intake manifold 68 including a bore 70 extending transversely across the width dimension of the pump and communicating with each of the cylinders 52, 54 and 56 by way of a bore 72, a counterbore 74 and a laterally extending bore 76 joining the counterbore 74 to the cylinder bores 52–56.

Similarly, the cylinder head 50 also includes a transversely extending outlet manifold including the bores 78, 80 and 82 (FIG. 2), which communicate with a common transversely extending bore (not shown).

A pump inlet 84 is adapted to be connected to a source of fluid to be pumped and is in fluid communication with the intake manifold's bore 70. The high pressure fluid outlet is identified by numeral 86 and is in fluid communication with the pump's outlet manifold (not shown).

Each of the cylinders 52–56 is provided with an associated intake poppet valve assembly, only one of which is shown in FIG. 1. It is identified by numeral 88 and is arranged to fit within the bore 74. It is seen to include a cage 89 containing a valve spring 91 normally urging a poppet member 93 against a seat formed in the annular base of the cage 89. The poppet valves are held in place by threaded plug members as at 90 or 92 in FIG. 2. By removing these plugs, it is possible to lift out the valve assembly 88 for replacement. In a similar fashion, there is disposed in bores associated with the outlet manifold an outlet valve assembly 94 substantially identical in construction to the inlet valve 89, which is held within the bore in the cylinder head 50 by a threaded plug 96.

The structure thus far described is deemed conventional for a multipiston, positive-displacement fluid pump and is set forth herein to provide the environment in which the present invention finds use.

Referring to FIG. 1, the chemical injector of the present invention is identified generally by numeral 10 and is seen to include a threaded plug 102 similar in construction to the plugs 90 and 92, except that it further includes a longitudinal bore 104 and a threaded counterbore 106 extending through the height dimension thereof. Screwed into the counterbore 106 is a check valve 108 having a stem portion 110 which is adapted to be connected to a tube or hose leading to the chemical supply tank (not shown). The check valve 108 also includes a ball member 112 which is biased to its seated position in the stem 110 by a coil spring 114. The injector assembly further includes a restrictor member 116 which comprises a flat washer whose central opening is determined empirically to provide a desired ratio between the two fluids drawn into the chamber 52 during the suction stroke of the plunger 58. The height dimension of the threaded plug 102 plus the thickness of the washer 116 is equal to the height of the plugs 90 and 92 and, hence, it is not required to drill the depth of the bore 74 differently for the three cylinders. This also allows the same intake valve assembly 88 can be used in each cylinder.

Having described the construction of the pump and injector of the present invention, consideration will next be given to its mode of operation.

OPERATION

As the shaft 14 is rotated by a prime mover (not shown), the plungers 58, 60 and 62 are made to move with reciprocal motion within their respective cylinders 52, 54 and 56. The eccentric lobes 24, 26 and 28 are such that the plungers move 120° out of phase with respect to one another. Each time the plunger 58 is drawn downward in its suction stroke, water is drawn through the inlet port 84 and the inlet manifold bore 70 to flow through the orifice in the restrictor plate 116 and through the now-open inlet valve assembly 88 into the cylinder 52. At the same time, the suction stroke is effective to create a negative pressure to overcome the bias of the spring 114 such that the ball check 112 is lowered from its seated position in the stem 110 and a second liquid (the chemical or soap) is also drawn past the ball check 112, through the longitudinal bore 74 and the valve assembly 88 into the cylinder 52. Here, the chemical and water mix and, during the next-following pressure stroke when the plunger 58 moves upward within its cylinder 52, the mixture is forced out through the outlet valve 94 and through the outlet manifold bore (not shown) to the pump's outlet port 86. During this pressure stroke, however, the liquid being pumped forces both the intake valve 88 and the check valve ball 112 to their seated position locking liquid flow back through the intake manifold or the bore of the injector 100. As mentioned earlier, the size of the opening in the restrictor 116 determines the fraction or ratio of liquid drawn into the chamber 52 during the suction stroke of plunger 58 from the intake manifold and the fraction drawn from the chemical supply tank through the injector assembly 100. The orifice size is predetermined by the pump's displacement. By making the orifice in the restrictor plate 72 smaller, a greater portion of the liquid drawn into the cylinder 52 comes from the chemical supply tank, via the injector, whereas if the opening in the restrictor washer 116 is larger, a greater proportion of the liquid entering the pumping chamber 52 comes via the intake manifold 68. Once the restrictor orifice size is determined, a simple inexpensive ball valve (not shown) located in the line coupling the chemical supply to the injector can be used to shut off or vary the amount of chemical liquid being injected.

The injector of the present invention allows chemical injection without any loss of working pressure or any sacrifice in fluid flow rate. As mentioned in the introductory portion of this patent specification, this is a distinct advantage over the commonly used venturi-type of injector. Furthermore, the ball check valve used in the injector 100 is less subject to wear or failure than is a needle valve and is much less expensive to manufacture than a needle valve, requiring fewer parts and less assembly time.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can he accomplished without departing from the scope of the invention itself.

What is claimed is:

1. In combination with a positive-displacement piston pump of the type including a crank case housing in which is journaled a crank shaft having one or more eccentric lobes, a connected rod coupled to each of said one or more lobes, a cylinder block including one or more cylinders, said block being attached to said crank case housing, plunger means disposed in each of said one or more cylinders and joined to said connecting rod for reciprocating movement within said cylinders, a cylinder head fastened to said cylinder block and including a fluid inlet port and a fluid outlet port, intake valve means individually operatively associated with each of said cylinders for allowing a one-way flow of a first fluid from said inlet port to said cylinders only during a suction stroke of its associated plunger means, outlet valve means individually operatively associated with each of said cylinders for allowing a one-way flow of said first fluid from said cylinders only during a pressure stroke of its associated plunger means, and a plug for each of said intake valve means and outlet valve means for holding said intake valve means and said outlet valve means in place in said cylinder head, the improvement comprising:

one of said plug means associated with a given intake valve means including injector valve means whereby that given intake valve means is held in place in said cylinder head while allowing a second fluid to be drawn into the cylinder associated with said given intake valve means during the suction stroke of the plunger means contained in that one cylinder.

2. The combination as in claim 1 wherein said injector means comprises:

a threaded plug member adapted to be screwed into a threaded bore in said cylinder head, said threaded bore containing an intake valve means, said threaded plug member including a longitudinal bore extending therethrough and a check valve disposed in said longitudinal bore for permitting one-way flow of said second fluid through said one intake valve means.

3. The combination as in claim 2 and further including restrictor means disposed between said inlet port and said one intake valve means for controlling the ratio of said first and second fluids drawn into the one cylinder associated with said one intake valve means during the suction stroke of the plunger means contained in that one cylinder.

4. The combination as in claim 3 wherein said check valve is a ball check valve.

5. The combination as in claim 3 wherein said restrictor means comprises a flat washer having a center opening of a predetermined radius.

* * * * *